US009840882B2

(12) United States Patent
Bailey

(10) Patent No.: US 9,840,882 B2
(45) Date of Patent: Dec. 12, 2017

(54) MASTER SHAKER MODULE FOR DRILLING RIG

(71) Applicant: Nabors Drilling International Limited, Hamilton (BM)

(72) Inventor: Sean M. Bailey, Willis, TX (US)

(73) Assignee: NABORS DRILLING INTERNATIONAL LIMITED, Hamilton (BM)

( * ) Notice: Subject to any disclaimer, the term of this patent is extended or adjusted under 35 U.S.C. 154(b) by 485 days.

(21) Appl. No.: 14/518,724

(22) Filed: Oct. 20, 2014

(65) Prior Publication Data

US 2016/0108688 A1 Apr. 21, 2016

(51) Int. Cl.
*E21B 21/06* (2006.01)

(52) U.S. Cl.
CPC ..... *E21B 21/065* (2013.01)

(58) Field of Classification Search
USPC ..... 175/66, 206, 207; 210/785, 384
See application file for complete search history.

(56) References Cited

U.S. PATENT DOCUMENTS 6,585,115 B1 * 7/2003 Reddoch ..... E21B 21/066 175/206
2005/0006149 A1 * 1/2005 Tettleton ..... E21B 21/065 175/66
2014/0190905 A1 * 7/2014 Burnett ..... B07B 1/46 210/780
2015/0375145 A1 * 12/2015 Sherwood ..... B07B 11/04 210/780

* cited by examiner

*Primary Examiner* — Caroline N Butcher
(74) *Attorney, Agent, or Firm* — Haynes and Boone, LLP

(57) ABSTRACT

An apparatus that includes an upper skid including a first floor supporting a first plurality of mud circulation components; a first storage structure disposed below the first floor that receives a fluid exiting the first plurality of components; and a first plurality of fasteners carried on the upper skid. The apparatus also includes a lower skid that includes a second floor supports a second plurality of mud circulation components; a second storage structure disposed below the second floor that receives a fluid exiting the second plurality of components; and a second plurality of fasteners carried on the support structure that correspond to the first plurality of fasteners to couple the upper skid over the lower skid. In an exemplary embodiment, the upper skid is selectively detachable from the lower skid.

23 Claims, 7 Drawing Sheets

MASTER SHAKER MODULE FOR DRILLING RIG

TECHNICAL FIELD

The present disclosure relates in general to mud circulating equipment, and in particular, to a master shaker module for a drilling rig.

BACKGROUND OF THE DISCLOSURE

Some underground drilling processes require that operators circulate drilling fluid, known as mud, to a bottom hole assembly cutting through subterranean formations. The mud, along with cuttings from the drilling process, flow back up the wellbore to the surface. A mud circulation system is generally required, which includes a mud pump system that circulates the mud down the drill string and up an annulus formed between the drill string and the wellbore. The mud is cleaned, and cuttings are removed before recirculating the mud back down into the wellbore. In order to clean the mud, the mud is passed through a shaker and a mud cleaner of the mud circulation system, where the cuttings are removed and discarded.

In offshore drilling, cranes are generally required to load the drilling equipment onto a drilling platform during assembly of the drilling platform. Generally, smaller cranes are more cost efficient than larger cranes. Therefore, it is desirable for the drilling equipment to have a light weight, which allows a smaller crane to load the drilling equipment onto the drilling platform. Moreover, due to the cost associated with a large footprint of a drilling platform, drilling equipment that has a small footprint is desirous. As such, the arrangement, weight, and footprint of all mud circulation system components are important.

The present disclosure is directed to a master shaker module for drilling rigs and methods that overcome one or more of the shortcomings in the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
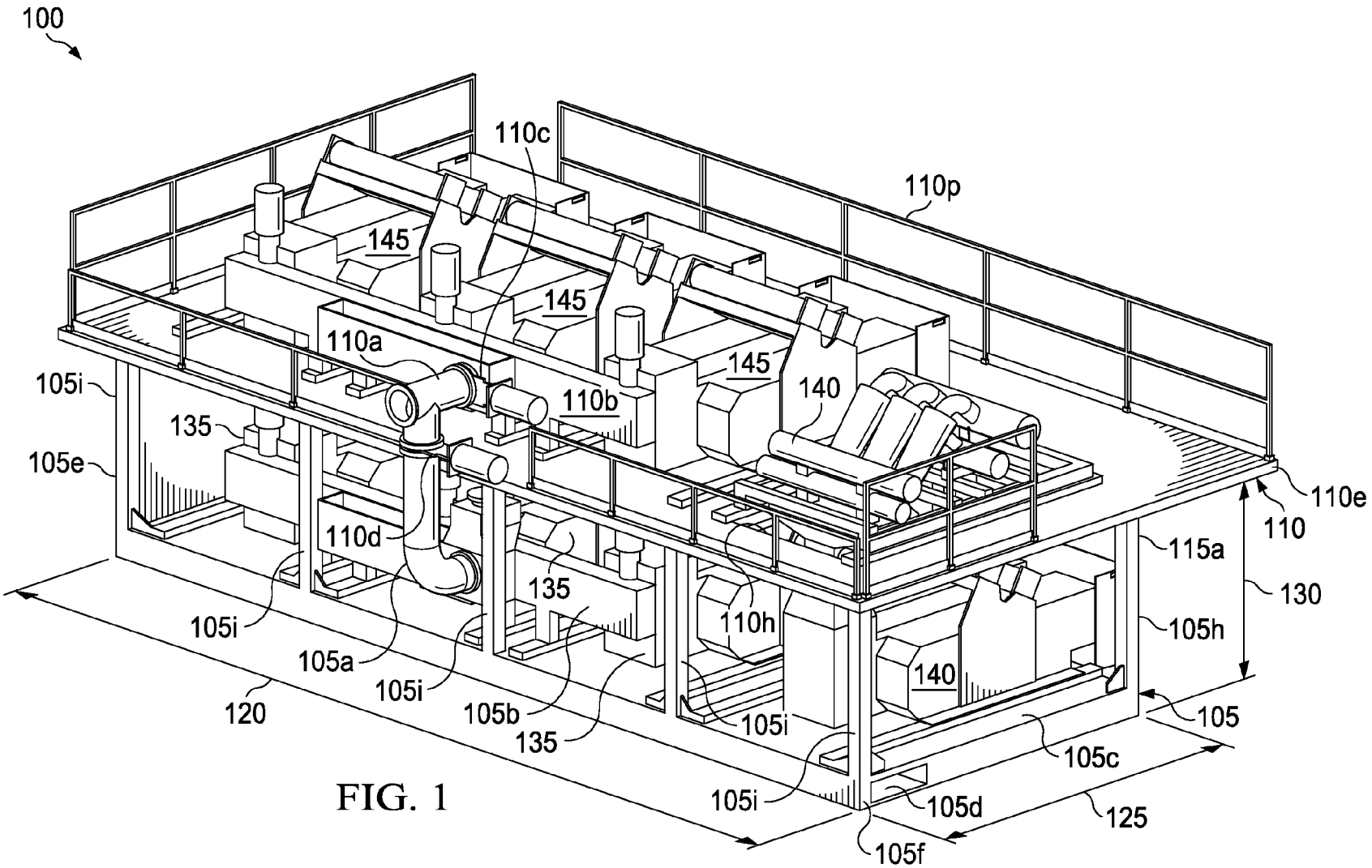
FIG. 1 is a perspective view of an apparatus according to one or more aspects of the present disclosure.
Figure 2:
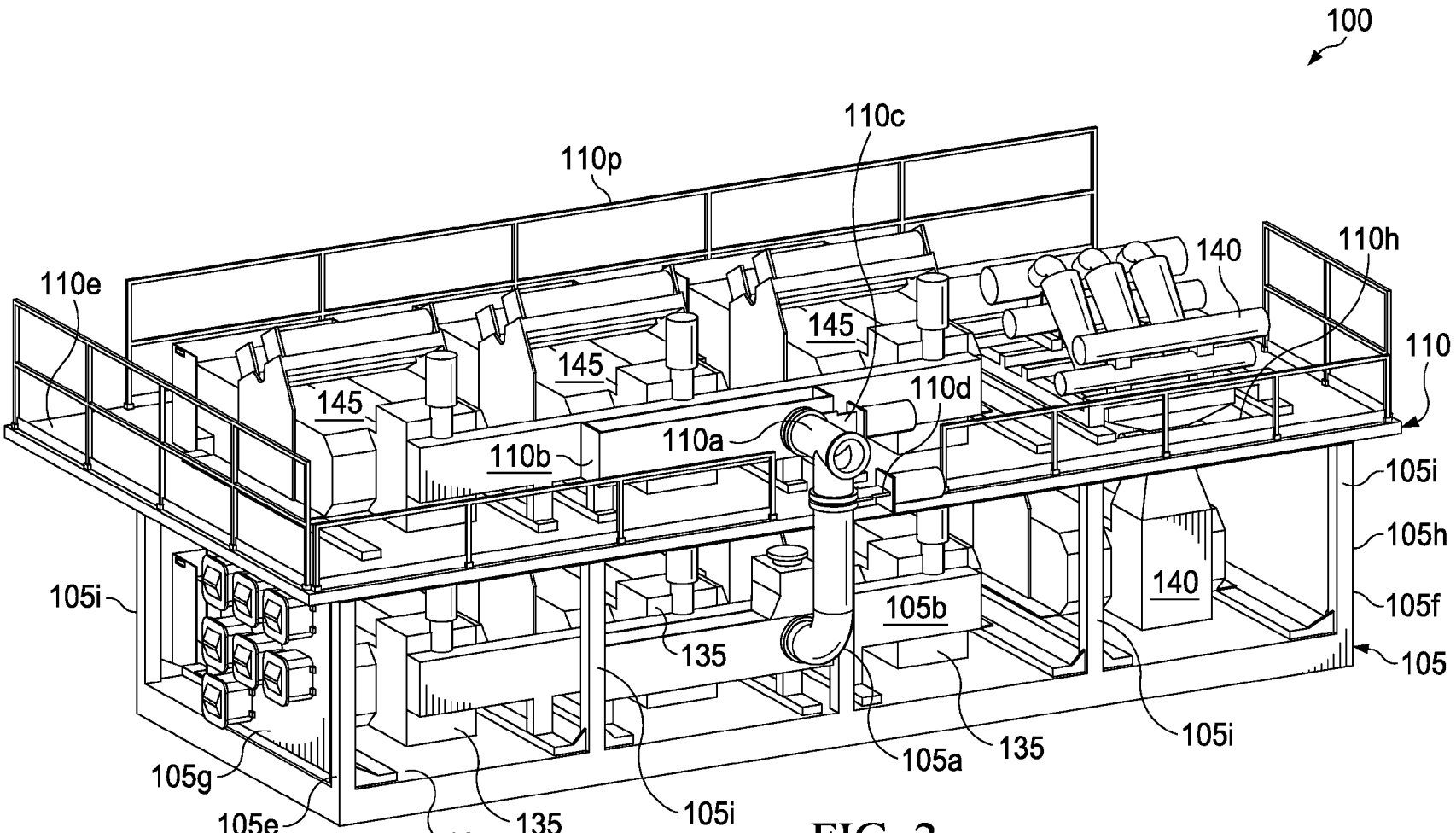
FIG. 2 is a perspective view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIGS. 1-4, illustrated is an apparatus shown as a master shaker module 100 demonstrating one or more aspects of the present disclosure. The master shaker module 100 may be disposed on a drilling rig, such as an offshore drilling rig where space is limited by the overall rig size. The master shaker module 100 may be in communication with the drilling bore hole and may receive used drilling mud from the borehole. In an exemplary embodiment, the master shaker module 100 includes a lower master skid 105 and an upper master skid 110. In one or more exemplary embodiments, the upper mast skid 110 and the lower master skid 105 are selectively detachable and support a plurality of mud circulation system components of a mud circulation system.

As set forth in more detail below, the master shaker module 100 supports mud circulation system components. However, unlike conventional mud circulation systems, the master shaker module 100 "stacks" at least a portion of the mud circulation system components, such as shale shakers, in a vertical direction using the upper master skid 110 that is selectively detachable from the lower master skid 105. Stacking the upper and lower master skids 105, 110 may reduce the footprint of the mud circulation system. Embodiments described herein are separable to permit the lower and upper master skids 105, 110 to be separated for weight reduction resulting in reduced handling loads. The lower and upper master skids 105, 110 may also be attached to one another for pick-up in one piece for easier and faster rig assembly. Additionally, and due to the configuration of the master shaker module 100, a portion of the shale shakers may be easily isolated from the mud circulation system. This may reduce costs by only operating a portion of the shale shakers when a fluid, or mud, that is circulated down a drill string and up an annulus formed between the drill string and a wellbore may be adequately cleaned using less than all of the shale shakers.

In one or more exemplary embodiments, the lower master skid 105 has a length extending in the direction indicated by the numeral 120 illustrated in FIG. 1, a width extending in the direction indicated by the numeral 125 illustrated in FIG. 1, and a height extending in the direction indicated by the numeral 130 illustrated in FIG. 1. In one or more exemplary embodiments, the lower master skid 105 also includes a pipe 105*a* that is in fluid communication with a manifold 105*b* that extends along a portion of the length of the lower master skid 105. The manifold 105*b* is in fluid communication with a plurality of mud circulation system components, disclosed here as a plurality of shale shakers 135. In one or more exemplary embodiments, the plurality of shale shakers 135 and a mud cleaner 140 are spaced along the length of the lower master skid 105. In an exemplary embodiment, the manifold 105*b* has an elongated body that has a first side and an opposing second side. The body of the manifold 105*b* may include an opening (not shown) on the first side such that when the pipe 105*a* is coupled to the manifold 105*b*, the fluid may flow from the pipe 105*a* and into the body of the manifold 105*b* via the opening. In an exemplary embodiment, the manifold 105*b* has multiple openings spaced along the second side such that the fluid may flow from the body to each of the plurality of shale shakers 135 via the multiple openings. In one or more exemplary embodiments, the manifold 105*b* is configured to encourage equal distribution of the fluid to each of the shale shakers in the plurality of shale shakers 135. In an exemplary embodiment, a plurality of baffles (not shown) are accommodated within the body of the manifold 105*b* to disperse the fluid and to encourage equal distribution of the fluid to each of the shale shakers in the plurality of shale shakers 135.

In an exemplary embodiment, the lower master skid 105 also includes a floor 105*c* that supports the plurality of shale shakers 135 and a subfloor 105*d* that is located below the floor 105*c*. In one or more exemplary embodiments, the lower master skid 105 has a first end 105*e* and an opposing second end 105*f*. In one or more exemplary embodiments, a master control panel 105*g* (FIG. 2) is located near or on the first end 105*e*. In one or more exemplary embodiments, the master control panel 105*g* includes control equipment, such as for example, a power switch, for each of the shakers in the plurality of shale shakers 135. In an exemplary embodiment, the location of the master control panel 105*g* prevents an operator from coming into close contact with each of the shakers in the plurality of shale shakers 135 and may decrease an amount of debris or other material that comes into contact with the control equipment for each of the shakers in the plurality of shale shakers 135. In an exemplary embodiment, the plurality of shale shakers 135 are positioned along the width of the lower master skid 105 such that a debris exit of each of the shale shakers from the plurality of shale shakers 135 extends beyond the floor 105*c* and the subfloor 105*d*, or is located near the perimeter of the floor 105*c* and the subfloor 105*d*. That is, the floor 105*c* and the subfloor 105*d* do not extend under the debris exit of each of the shale shakers from the plurality of shale shakers 135.

Figure 5:
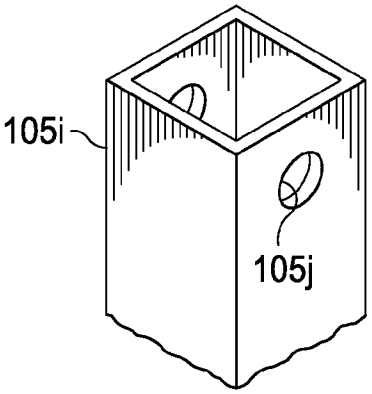
FIG. 5 is a perspective view of a fastener, according to one or more aspects of the present disclosure.

In one or more exemplary embodiments, the lower master skid 105 includes a support structure 105*h* that includes a plurality of vertically extending supports 105*i* extending from the floor 105*c* or the subfloor 105*d* or both. In one or more exemplary embodiments, the vertically extending supports 105*i* have a height within the range of 5 feet to 10 feet. However, a variety of heights are contemplated here. In an exemplary embodiment, and as illustrated in FIG. 5, a fastener 105*j* may be located near a top portion of the supports 105*i*. In one or more exemplary embodiments, the fastener 105*j* may be a slot or another opening, a pin system, a bolt, a screw, or any other type(s) of adequate fastener.

Figure 3:
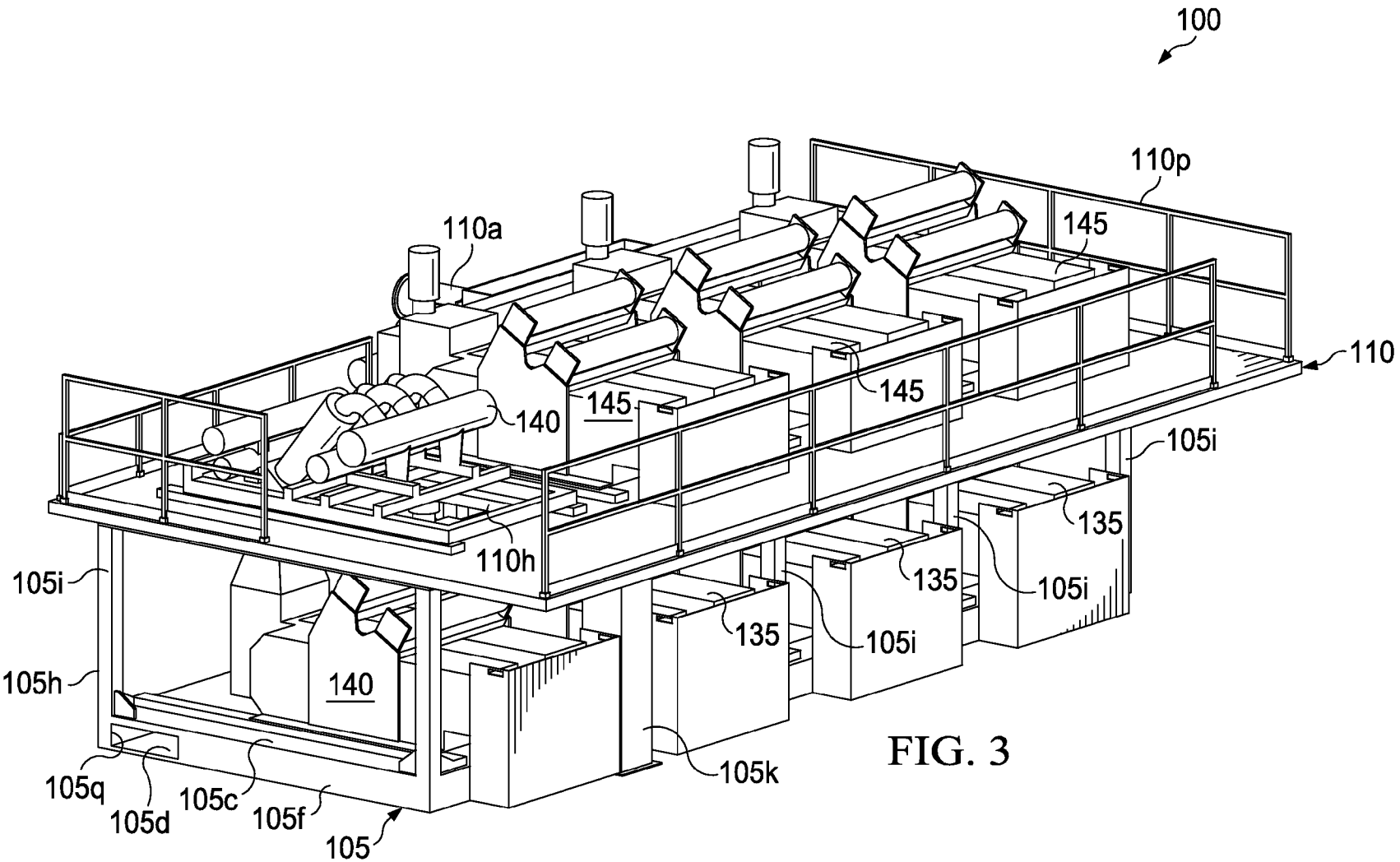
FIG. 3 is a perspective view of an apparatus according to one or more aspects of the present disclosure.
Figure 4:
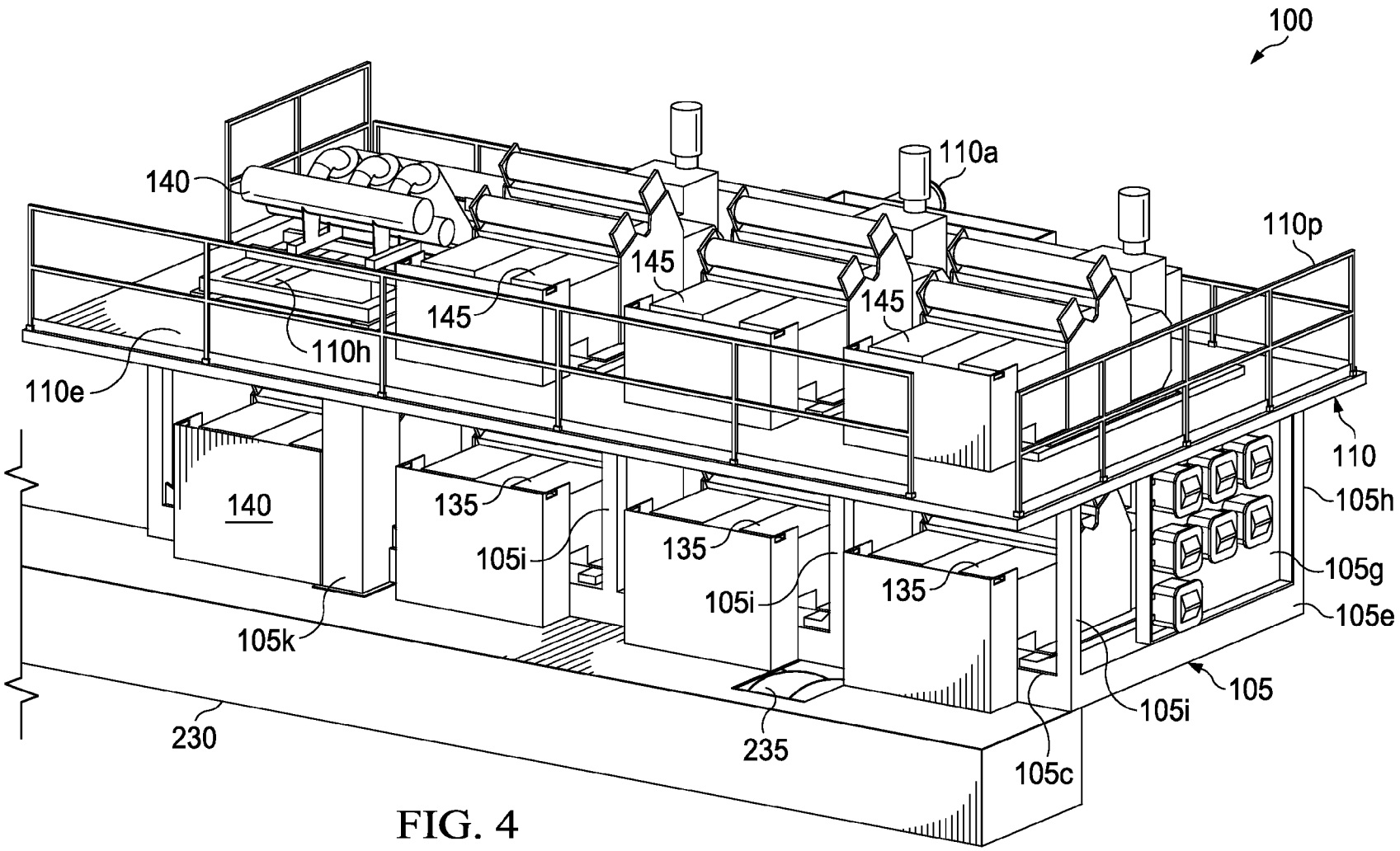
FIG. 4 is a perspective view of an apparatus according to one or more aspects of the present disclosure.
Figure 6:
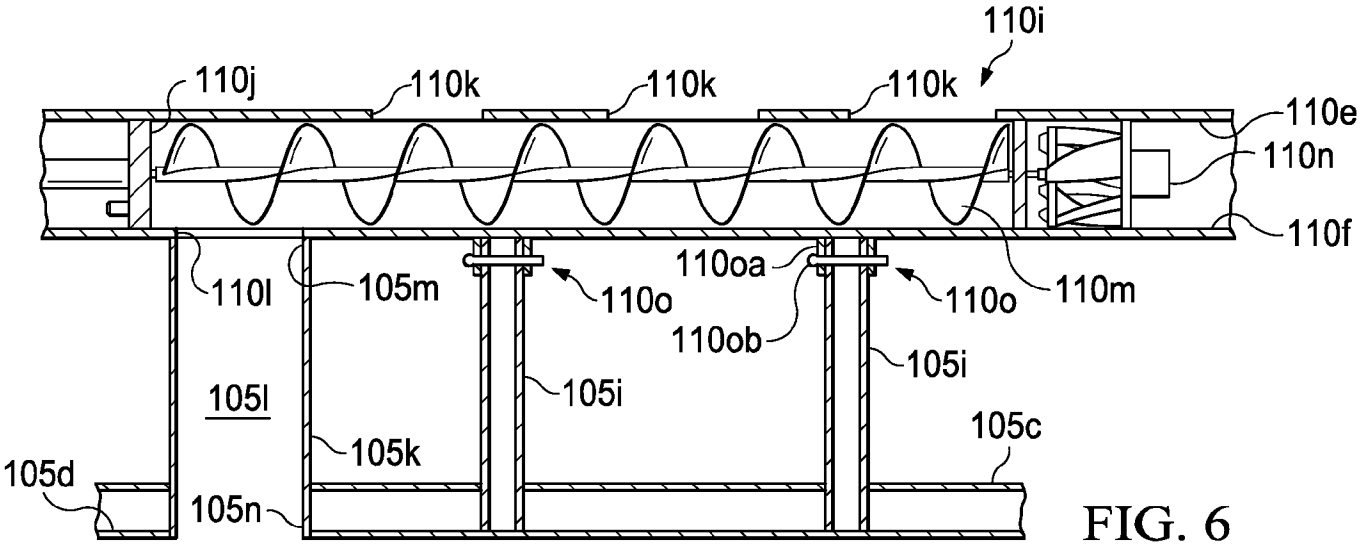
FIG. 6 is a sectional view of a portion of the apparatus of FIG. 1, according to one or more aspects of the present disclosure.

In one or more exemplary embodiments and as illustrated in FIGS. 3, 4, and 6, the lower master skid 105 also includes a chute 105*k* forming a flow path 105*l* (FIG. 6) that extends between an upper opening 105*m* (FIG. 6) of the chute 105*k* to a lower opening 105*n* (FIG. 6) of the chute 105*k*. The flow path 105*l* extends along the height of the lower master skid 105.

Figure 7:
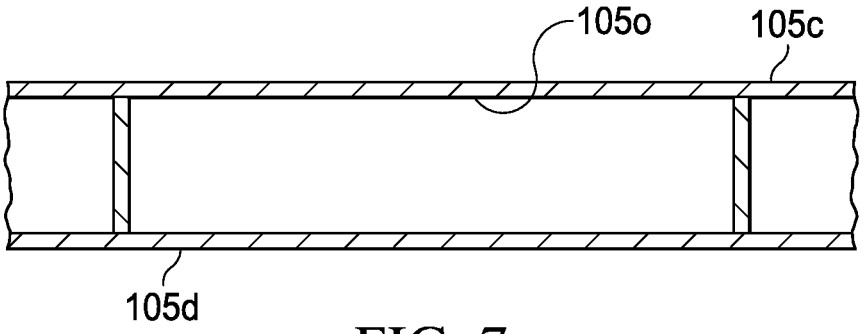
FIG. 7 is a sectional view of another portion of the apparatus of FIG. 1, according to one or more aspects of the present disclosure.

In an exemplary embodiment and as illustrated in FIG. 7, a storage structure 105*o*, commonly referred to as a "possum belly" is located between the floor 105*c* and the subfloor 105*d*. In an exemplary embodiment, the storage structure 105*o* is configured to receive and accommodate the fluid or mud exiting the plurality of shale shakers 135. The storage structure 105*o* is fluidically connected to the mud cleaner 140 so that the mud or the fluid may enter the mud cleaner 140 from the storage structure 105*o* for cleaning. Accordingly, in the embodiments described herein, the support or floor structures are both structures and configured to be a part of the treatment process (i.e., cleaning the mud). In an exemplary embodiment, and referring back to FIG. 3, the lower master skid 105*o* has an outlet opening 105*q* that is in fluid communication with the storage structure 105*o*. In an exemplary embodiment, the outlet opening 105*q* is accessible from the end 105*f*, the end 105*e*, the floor 105*c* or the floor 105*d*. In one or more exemplary embodiments, cleaned mud flows through the outlet opening 105*q* and is recirculated downhole.

In one or more exemplary embodiments and referring back to FIGS. 1-4, the upper master skid 110 has a length extending in the direction indicated by the numeral 120 and a width extending in the direction indicated by the numeral 125. In this embodiment, the width of the upper master skid 110 is greater than the width of the lower master skid 105. In this embodiment, the length of the upper master skid 110 is greater than the length of the lower master skid 105. In one or more exemplary embodiments, the upper master skid 110 also includes a pipe 110*a* fluidically coupled to a manifold 110*b* that extends along a portion of the length of the upper master skid 110. The manifold 110*b* is in fluid communication with a plurality of mud circulation system components, disclosed here as a plurality of shale shakers 145. In one or more exemplary embodiments, the plurality of shale shakers 145 are spaced along the length of the upper master skid 110. In an exemplary embodiment, the manifold 110*b* has an elongated body that has a first side and an opposing second side. The body of the manifold 110*b* may include an opening on the first side such that when the pipe 110*a* is coupled to the manifold 110*b*, the fluid may flow from the pipe 110*a* and into the body via the opening. In an exemplary embodiment, the manifold 110*b* has multiple openings (not shown) spaced along the second side such that the fluid may flow from the body of the manifold 110*b* to each of the plurality of shale shakers 145 via the multiple openings. In one or more exemplary embodiments, the manifold 110*b* is configured to encourage equal distribution of the fluid to each of the shale shakers in the plurality of shale shakers 145. In an exemplary embodiment, a plurality of baffles (not shown) are accommodated within the body of the manifold 110*b* to disperse the fluid and to encourage equal distribution of the fluid to each of the shale shakers in the plurality of shale shakers 145. In one or more exemplary embodiments, the upper mast skid 110 also includes a first valve 110*c* that controls the flow of the fluid from the pipe 110*a* to the manifold 110*b*. In another exemplary embodiment, the upper master skid 110 also includes a second valve 110*d* that controls the flow of the fluid from the pipe 110*a* of the upper master skid 110 to the pipe 105*a* of the lower master skid 105.

Figure 8:
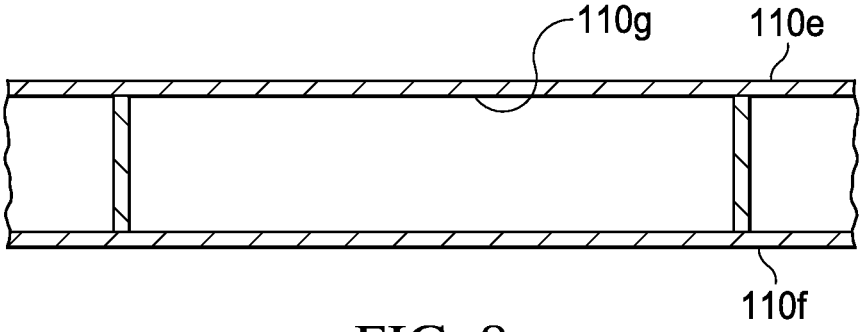
FIG. 8 is a sectional view of yet another portion of the apparatus of FIG. 1, according to one or more aspects of the present disclosure.

In an exemplary embodiment and as illustrated in FIG. 8, the upper master skid 110 also includes a floor 110*e* that supports the plurality of shale shakers 145 and a subfloor 110*f* that is located below the floor 110*e*. In one or more exemplary embodiments, a storage structure 110*g*, commonly referred to as a "possum belly" is located between the floor 110*e* and the subfloor 110*f*. In an exemplary embodiment, the storage structure 110*g* is configured to receive and accommodate the fluid or mud exiting the plurality of shale shakers 145. The storage structure 110*g* is in fluid communication with the mud cleaner 140 so that the mud or the fluid may enter the mud cleaner 140 from the storage structure 110*g* for cleaning.

In one or more exemplary embodiments and referring back to FIGS. 1-4, the floor 110*e* and the subfloor 110*f* form an opening 110*h* through which a portion of the mud cleaner 140 extends. That is, the mud cleaner 140 is disposed on the floor 105*c* of the lower master skid 105 such that a portion of the mud cleaner 140 extends through the opening 110*h* of the upper mast skid 110. In an exemplary embodiment, the height of the vertically extending supports 105*i* relates to a vertical spacing between the floor 105*c* of the lower master skid 105 and the subfloor 110*f* of the upper master skid 110. In an exemplary embodiment, the vertically extending supports 105*i* are associated with a height that allows the first plurality of shale shakers 135 to be positioned under (in the vertical direction) the second plurality of shale shakers 145.

In one or more exemplary embodiments and referring back to FIG. 6, the upper master skid 110 also includes a debris moving system ("DMS") 110*i* that is at least partially accommodated between the floor 110*e* and the subfloor 110*f* and that is configured to receive and move debris received from the plurality of shale shakers 145. In one or more exemplary embodiments, the DMS 110*i* includes a trough 110*j* that extends along a portion of the length of the upper mast skid 110. In an exemplary embodiment, the trough 110*j* includes a plurality of openings 110*k*, with each opening from the plurality of openings 110*k* associated with a debris exit of each of the shale shakers from the plurality of shale shakers 145. In an exemplary embodiment, the DMS 110*i* includes an opening 110*l* formed in the subfloor 110*f*. In one or more exemplary embodiments, the opening 110*l* of the upper master skid 110 is at least partially aligned with the opening 105*m* and the flow path 105*l* of the lower master skid 105. In one or more exemplary embodiments, the DMS 110*i* includes a screw conveyor 110*m*, such as an auger, disposed within the trough 110*j* that is coupled to a motor 110*n* such that activation of the motor 110*n* moves the screw conveyor 110*m* to move the debris through the trough 110*j* and into the opening 110*l*. In one or more exemplary embodiments, the DMS 110*i* may include a variety of systems, such as for example a conveyor belt or other conveyor. In one or more exemplary embodiments, the screw conveyor 110*m* may be a 12" screw conveyor. However, any sized screw conveyor is contemplated here.

In one or more exemplary embodiments, a plurality of fasteners 110*o* are located on a bottom portion of the upper master skid 110, such as the floor 110*e* or the subfloor 110*f* or both. In one or more exemplary embodiments, at least one fastener from the plurality of fasteners 110*o* corresponds with at least one fastener from the plurality of fasteners 105*j*. In one or more exemplary embodiments, the plurality of fasteners 110*o* may include a receiving sleeve 110*oa* that receives the vertical support 105*i* and a pin system 110*ob* that extends through the fastener 105*j*, a slot, bolts, screws, or any other type(s) of adequate fastener.

In one or more exemplary embodiments and referring back to FIGS. 1-4, the upper master skid 110 also includes railings 110*p* or other guards located around the perimeter of the upper master skid 110. In one or more exemplary embodiments, the master control 105*g* of the lower master skid 105 also includes a control for each of the shakers in the plurality of master shakers 145.

Figure 9:
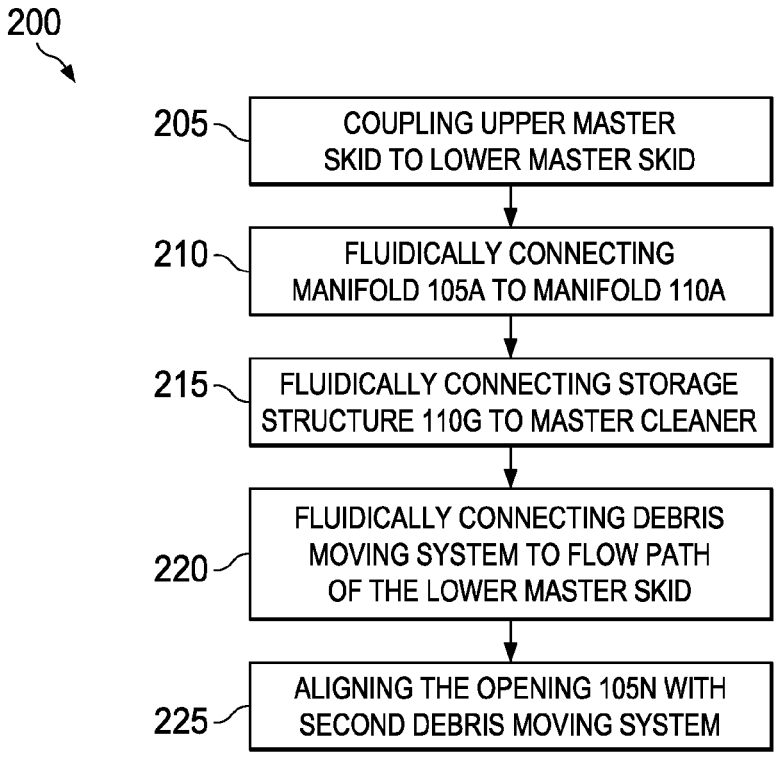
FIG. 9 is a flow-chart diagram of at least a portion of a method according to one or more aspects of the present disclosure.

As illustrated in FIG. 9, a method of preparing the master skid 100 for mud cleaning operations is generally referenced as numeral 200. The method 200 includes coupling the upper master skid 110 to the lower master skid 105 at step 205; fluidically connecting the pipe 105*a* to the pipe 110*a* at step 210, fluidically connecting the storage structure 110*g* to the master cleaner 140 at step 215; fluidically connecting the DMS 110*i* to the flow path 105*l* at step 220; and aligning the opening 105*n* with a second debris moving system 230 at step 225. Details of these steps are provided below.

In an exemplary embodiment, the upper master skid 110 is coupled to the lower master skid 105 at the step 205. In an exemplary embodiment, the upper master skid 110 is aligned over the lower master skid 105 such that at least one of the fasteners from the plurality of fasteners 110*o* align with at least one of the fasteners from the plurality of fasteners 105*j*. In one or more exemplary embodiments, at least one of the fasteners from the plurality of fasteners 110*o* is then coupled to at least one of the fasteners from the plurality of fasteners 105*j*.

In an exemplary embodiment, the pipe 110*a* is fluidically coupled to the pipe 105*a* at the step 210. In an exemplary embodiment, the pipe 110*a* is fluidically coupled to the pipe 105*a* using traditional pipe connections. In an exemplary embodiment, the pipe 105*a* is coupled to the pipe 110*a* such that the valve 110*d* may fluidically isolate the pipe 105*a* from the pipe 110*a*.

In an exemplary embodiment, the storage structure 110*g* of the upper master skid 110 is fluidically connected to the mud cleaner 140 at the step 215. In one or more exemplary embodiments, the storage structure 110*g* is coupled to the mud cleaner 140 such that the fluid or mud accommodated within the storage structure 110*g* may be transferred, via gravity or otherwise, to the mud cleaner 140 for cleaning.

In an exemplary embodiment, the DMS 110*i* is fluidically coupled to the flow path 105*l* of the lower master skid 105 at the step 220. In one or more exemplary embodiments, aligning at least one of the fasteners from the plurality of fasteners 110*o* of the upper master skid 110 to at least one of the fasteners from the plurality of fasteners 105*j* of the lower master skid 105 also aligns the flow path 105*l* of the lower master skid 105 with the opening 110*l* of the DMS 110*i* of the upper master skid 110.

In an exemplary embodiment, the opening 105*n* of the lower master skid 105 is aligned with a second debris moving system 230 at the step 225. In an exemplary embodiment, the master shaker 100 is located on a supporting surface on a platform. In an exemplary embodiment, the second debris moving system 230 is at least partially located below the supporting surface. Generally, the second debris moving system 230 is substantially identical to the DMS 110*i* and therefore will not be described here. Generally, the second debris moving system 230 includes a screw conveyor 235 that moves the debris to another location. Thus, aligning the opening 105*n* with an opening (not shown) to the second debris moving system 230 allows for the debris that exits the plurality of shale shakers 145 to enter the opening of the second debris moving system and be moved away from the master shaker 100, using the screw conveyor 235. In an exemplary embodiment, the screw conveyor 235 is a 20 inch auger. However, some embodiments employ an auger in the range of 12 to 24 inches depending on the flow requirements. Larger and smaller augers may be utilized depending on the flow requirements. In an exemplary embodiment, aligning the opening 105*n* with the second debris moving system 230 also aligns the exits of the plurality of shale shakers 135 with openings (not shown) of the second debris moving system 230 (FIG. 4) such that the debris from the plurality of shale shakers enters the second debris moving system 230 and is also moved away from the master shaker 100, using the screw conveyor 235.

In an exemplary embodiment, the method 200 is used to provide a master shaker 100 that has a reduced footprint and weight. In an exemplary embodiment, the method 200 is used to provide a master shaker 100 that can be moved using a crane have a 140,000 lb. at 30 ft. capacity. Other sizes may also be used. In an exemplary embodiment, the method 200 results in a vertically stacked mud cleaning system. In an exemplary embodiment, the method 200 results in the plurality of shale shakers 135 positioned under the plurality of shale shakers 140. In one or more exemplary embodiments, the method 200 results in a selectively detachable master shaker module 100, as the upper master skid 110 may be detached and attached to the lower master skid 105. In an exemplary embodiment, the method 200 results in mud circulation system having the plurality of shale shakers 135 that may be fluidically isolated from the mud circulation system. In an exemplary embodiment, the method 200 results in a mud circulation system having a plurality of shale shakers 145 that may be fluidically isolated from the mud circulation system.

Figure 10:
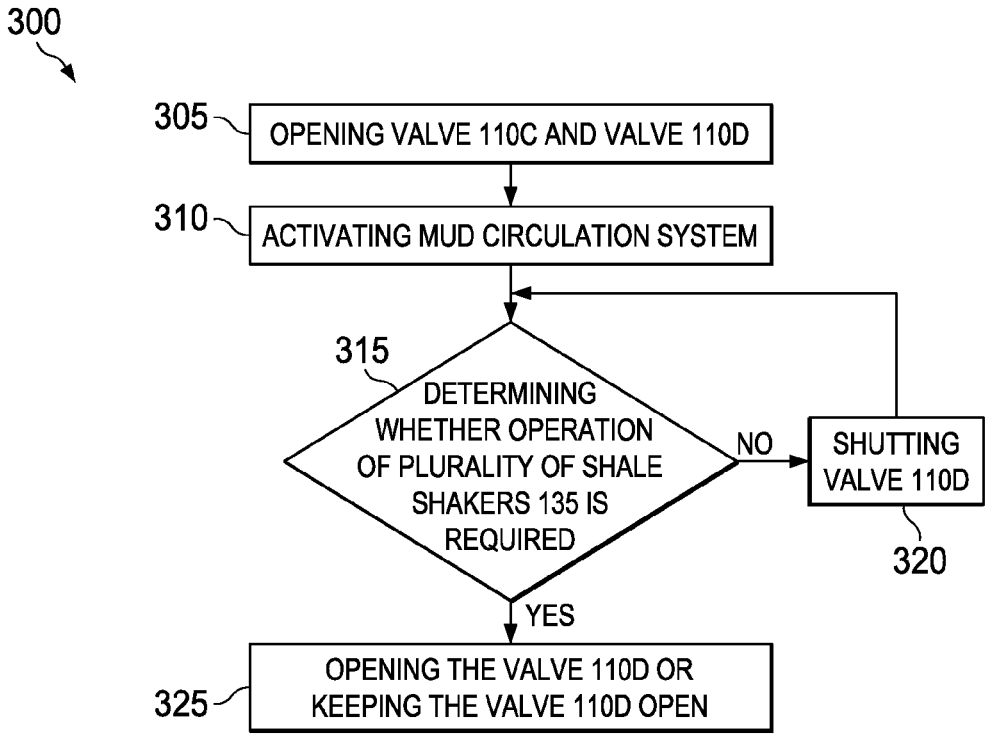
FIG. 10 is a flow-chart diagram of at least a portion of a method according to one or more aspects of the present disclosure.

As illustrated in FIG. 10, a method of operating the master shaker module 100 is generally referenced as numeral 300. The method 300 includes opening the valve 110*c* and the valve 110*d* at step 305, activating the mud circulation system at step 310, determining whether operating the plurality of shale shakers 135 is required to adequately clean the mud at step 315; if not, shutting the valve 110*d* and returning to the step 315; if so, opening the valve 110*d* or keeping the valve 110*d* open at step 325.

In an exemplary embodiment, the valve 110*c* and the valve 110*d* are opened at the step 305. In an exemplary embodiment, opening the valves 110*c* and 110*d* allows the fluid to flow through the upper pipe 110*a* to the manifold 110*b* and through the lower pipe 105*a* to the lower manifold 105*b* at step 305.

In an exemplary embodiment, the mud circulation system is activated at the step 310. In one or more exemplary embodiments, operation of the mud circulation system forces the fluid through the upper pipe 110*a* and into the manifold 110*b* and forces the fluid through the lower pipe 105*a* and into the manifold 105*b* when the valves 110*c* and 110*d* are in an open or partially open position. After entering the manifolds 105*b* and 110*b*, the fluid passes through one of the plurality of shale shakers 135 and 145 for processing. In one or more exemplary embodiments, the manifold 110*b* encourages equal distribution of the fluid to the plurality of shale shakers 145. Similarly, the manifold 105*b* may encourage equal distribution of the fluid to the plurality of shale shakers 135.

In an exemplary embodiment, it is determined whether operation of the plurality of shale shakers 135 are required to adequately clean the mud at the step 315. In an exemplary embodiment, during certain drilling and/or completion operations, only a small amount of debris will be present in the mud. Thus, there are often situations in which only a portion of the shale shakers within the plurality of shale shakers 135 and 145 are required. For example, during circulation of the mud downhole (no drilling), the plurality of shale shakers 145 may adequately clean the mud. While, when drilling operations are performed, both the plurality of shale shakers 135 and 145 may be required to adequately clean the mud. In an exemplary embodiment, it is determined whether operation of the plurality of shale shakers 135 is required. If not, the valve 110*d* is shut at the step 320 and the step 315 is the next step. Otherwise, and if the operation of the plurality of shale shakers is required, the next step is 325.

In an exemplary embodiment, and if the operation of the plurality of shale shakers 135 is not required at the step 315, the valve 110*d* is shut at the step 320. In an exemplary embodiment, shutting the valve 110*d* fluidically isolates the plurality of shale shakers 135 from the pipe 110*a* and from the flow of the fluid. In an exemplary embodiment, shutting the valve 110*d* isolates the plurality of shale shakers 135 from the mud circulation system.

In an exemplary embodiment, and if the operation of the plurality of shale shakers 135 is required at the step 315, the valve 110*d* is opened or remains open at the step 325. In an exemplary embodiment, opening the valve 325 fluidically connects the plurality of shale shakers 135 to the pipe 105*a*.

In an exemplary embodiment, the method 300 is used to process the fluid using a minimal amount of shale shakers. In one or more exemplary embodiments, the method 300 may extend the life of mud cleaning equipment, as the mud cleaning equipment is only operated when required. In an exemplary embodiment, the method 300 is used to process the fluid using only a portion of the shale shakers, therefore the master shaker module 100 is a segmentable master shaker, as a portion of the shale shakers may be isolated from the mud circulation system. In an exemplary embodiment, the master shaker module 100 unitizes flow paths to reduce redundant weight.

In an exemplary embodiment, the method 300 may be altered in a variety of ways. For example, instead of determining whether the plurality of shale shakers 135 is required, the method 300 may include determining whether the plurality of shale shakers 145 is required. Additionally, instead of opening and closing the valve 110*d* in the step 320 and 325, the method 300 may include opening and closing the valve 110*c* in the steps 320 and 325. That is, instead of isolating the plurality of shale shakers 135 from the mud circulating system, the plurality of shale shakers 145 may be isolated from the mud circulating system.

In an exemplary embodiment, any number of shale shakers may be aligned along the length of the upper master skid 110 and the lower master skid 105. Alternatively, additional mud circulation equipment, such as a centrifuge, may be aligned along the length of the upper master skid 110 or the lower master skid 105 or both. In an exemplary embodiment, each of the valves 110*c* and 110*d* has an actuator that controls the opening and the closing of the valves 110*c* and 110*d*. In an exemplary embodiment, the actuator may be coupled to a controller that is also is in communication with the controls of each of the shale shakers in the plurality of shale shakers 135 and 145. Thus, upon determining that either the plurality of shale shakers 135 or the plurality of shale shakers 145 may be isolated from the mud circulation system, the controller may power off the plurality of shale shakers 135 and control the actuator to close the valve 110*d* or may power off the plurality of shale shakers 145 and control the actuator to close the valve 110*c*.

In an exemplary embodiment, the floors 105*c*, 105*d*, 110*e*, and 110*f* may be a solid surface, a grate, a cross-support or other support structure.

The present disclosure also introduces an apparatus that includes an upper master skid that includes a first floor configured to support a first plurality of mud circulation system components; a first storage structure at least partially disposed below the first floor and structurally configured to receive a fluid exiting the first plurality of mud circulation system components; a debris moving system at least partially disposed below the first floor and structurally configured to receive debris exiting the first plurality of mud circulation system components; and a first plurality of fasteners carried on the upper master skid; and a lower master skid that includes a second floor configured to support a second plurality of mud circulation system components; a second storage structure at least partially disposed below the second floor and structurally configured to receive a fluid exiting the first plurality of mud circulation system components; and a second plurality of fasteners carried on the lower master skid and configured to correspond to the first plurality of fasteners to couple the upper master skid over the lower master skid. In one exemplary embodiment, the upper master skid and the lower master skid are selectively detachable. In another exemplary embodiment, the apparatus also includes a support structure extending between the upper master skid and the lower master skid and configured to support the upper master skid such that the first plurality of mud circulation system components are located above the second plurality of mud circulation system components. In one exemplary embodiment, the lower master skid further includes a chute extending in the vertical direction and configured to couple to the debris moving system. In yet another exemplary embodiment, the debris moving system includes a trough configured to receive debris that exits from at least one of the mud circulation system components from the first plurality of mud circulation system components; and a conveyor accommodated within the trough that is structurally configured to move the debris in a first direction along the trough to the chute. In another exemplary embodiment, the upper master skid further includes a first pipe that is fluidically coupled to the first plurality of mud circulation system components and configured to allow the fluid to flow into the first plurality of mud circulation system components; and the lower master skid further includes a second pipe that is fluidically coupled to the second plurality of mud circulation system components and configured to allow the fluid to flow into the second plurality of mud circulation system components. In yet another exemplary embodiment, the upper master skid further includes a first valve that is structurally configured to fluidically isolate the first plurality of mud circulation system components from other mud circulation system components; and a second valve that is structurally configured to fluidically isolate the second plurality of mud circulation system components from the other mud circulation system components. In yet another exemplary embodiment, the upper master skid further includes a first manifold that fluidically connects the first pipe to the first plurality of mud circulation system components; and the lower master skid further includes a second manifold that fluidically connects the second pipe to the second plurality of mud circulation system components. In another exemplary embodiment, the first manifold encourages equal distribution of the fluid to each of the mud circulation system components in the first plurality of mud circulation system components; and the second manifold encourages equal distribution of the fluid to each of the mud circulation system components in the second plurality of mud circulation system components. In one or more exemplary embodiments, the second floor is configured to support a mud cleaner; and the first floor forms an opening configured to accommodate a portion of the mud cleaner. In another exemplary embodiment, at least one mud circulation system component of the first plurality of mud circulation system components is a shale shaker; and at least one mud circulation system component of the second plurality of mud circulation system components is a shale shaker.

The present disclosure also introduces a method that includes coupling an upper master skid structurally configured to support a first plurality of mud circulation system components over and to a lower master skid structurally configured to support a second plurality of mud circulation system components; fluidically connecting a first pipe of the upper master skid to a second pipe of the lower master skid; fluidically connecting a first storage structure of the upper master skid to a mud cleaner accommodated on the lower master skid, the first storage structure being configured to receive a fluid that exits from the first plurality of mud circulation system components; and fluidically connecting a first debris moving system of the upper master skid to a chute that vertically extends along the lower master skid, the first debris moving system being structurally configured to move debris that exits from the first plurality of mud circulation system components; the first pipe is arranged to fluidly communicate with the first plurality of mud circulation system components; and the second pipe is arranged to fluidly communicate with the second plurality of mud circulation system components. In an exemplary embodiment, the upper master skid further includes a first floor configured to support the first plurality of mud circulation system components; and a first plurality of fasteners carried on the upper master skid; and wherein the lower master skid includes: a second floor configured to support the second plurality of mud circulation system components; a second storage structure at least partially disposed below the second floor and structurally configured to receive the fluid exiting from at least one mud circulation system components from the first plurality of mud circulation system components; a support structure extending in the vertical direction from the second floor; a second plurality of fasteners located on the support structure and configured to correspond to the first plurality of fasteners to couple the upper master skid to the lower master skid. In an exemplary embodiment, coupling the upper master skid to the lower master skid includes: positioning the upper master skid at a location above the lower maser skid; aligning at least one fastener from the first plurality of fasteners with at least one fastener from the second plurality of fasteners; and coupling at least one fastener from the first plurality of fasteners with at least one fastener from the second plurality of fasteners. In yet another exemplary embodiment, the method also includes aligning the chute of the lower master skid with a second debris moving system that is at least partially located below a support surface upon which the lower master skid rests. In an exemplary embodiment, the first debris moving system includes: a trough configured to receive the debris that exits from at least one of the mud circulation system components from the first plurality of mud circulation system components; and a conveyor accommodated within the trough and structurally configured to move the debris that exits from the at least one mud circulation system component from the first plurality of mud circulation system components in a first direction along the trough and to the chute. In an exemplary embodiment, at least one mud circulation system component from the first plurality of mud circulation system components is a shale shaker; and at least one mud circulation system component from the second plurality of mud circulation system components is a shale shaker. In an exemplary embodiment, the upper master skid and the lower master skid are selectively detachable.

The present disclosure also introduces a method that includes flowing a fluid through a first pipe to a first plurality of mud circulation system components accommodated on an upper master skid; flowing the fluid through a second pipe to a second plurality of mud circulation system components accommodated on a lower master skid that is located below the upper master skid; determining whether operation of both the first and second pluralities of mud circulation system components is required to clean the fluid; and closing a valve to prevent the flow of the fluid through one of the first and second pipes after determining that operation of both the first and second pluralities of mud circulation system components is not required. In an exemplary embodiment, at least one mud circulation system component from the first plurality of mud circulation system components includes a shale shaker; and wherein at least one mud circulation system component from the second plurality of mud circulation system components includes a shale shaker. In yet another exemplary embodiment, the method also includes accommodating the fluid that exits from at least one of the mud circulation system components from the first plurality of mud circulation system components within a first storage structure at least partially disposed below a first floor of the upper master skid; and accommodating the fluid that exits from at least one of the mud circulation system components from the second plurality of mud circulation system components within a second storage structure at least partially disposed below a second floor of the lower master skid. In another exemplary embodiment, the method also includes receiving debris that exits from at least one of the mud circulation system components from the first plurality of mud circulation system components through a trough formed below a first floor of the upper master skid, the first floor supporting the first plurality of mud circulation system components; moving the debris using a screw conveyor that is accommodated within the trough. In an exemplary embodiment, the upper master skid and the lower master skid are selectively detachable.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described herein.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

What is claimed is:

1. A master shaker module comprising:

an upper master skid comprising:

a first floor configured to support a first plurality of mud circulation system components;

a first storage structure in contact with and at least partially disposed below the first floor and structurally configured to receive a fluid exiting the first plurality of mud circulation system components;

a debris moving system at least partially disposed below the first floor and structurally configured to receive debris exiting the first plurality of mud circulation system components; and a first plurality of fasteners carried on the upper master skid; and a lower master skid comprising:

a second floor configured to support a second plurality of mud circulation system components;

a second storage structure at least partially disposed below the second floor and structurally configured to receive a fluid exiting the second plurality of mud circulation system components;

and a second plurality of fasteners carried on the lower master skid and configured to correspond to the first plurality of fasteners to couple the upper master skid over the lower master skid.

2. The master shaker module of claim 1, wherein the upper master skid and the lower master skid are selectively detachable.

3. The master shaker module of claim 1, comprising a support structure extending between the upper master skid and the lower master skid and configured to support the upper master skid such that the first plurality of mud circulation system components are located above the second plurality of mud circulation system components.

4. The master shaker module of claim 1, wherein the lower master skid further comprises:

a chute extending in the vertical direction and configured to couple to the debris moving system.

5. The master shaker module of claim 4, wherein the debris moving system comprises:

a trough configured to receive debris that exits from at least one of the mud circulation system components from the first plurality of mud circulation system components; and a conveyor accommodated within the trough that is structurally configured to move the debris in a first direction along the trough to the chute.

6. The master shaker module of claim 1, wherein the upper master skid further comprises a first pipe that is fluidically coupled to the first plurality of mud circulation system components and configured to allow the fluid to flow into the first plurality of mud circulation system components; and wherein the lower master skid further comprises a second pipe that is fluidically coupled to the second plurality of mud circulation system components and configured to allow the fluid to flow into the second plurality of mud circulation system components.

7. The master shaker module of claim 1, wherein the upper master skid further comprises:

a first valve that is structurally configured to fluidically isolate the first plurality of mud circulation system components from other mud circulation system components; and a second valve that is structurally configured to fluidically isolate the second plurality of mud circulation system components from the other mud circulation system components.

8. The master shaker module of claim 6, wherein the upper master skid further comprises a first manifold that fluidically connects the first pipe to the first plurality of mud circulation system components; and wherein the lower master skid further comprises a second manifold that fluidically connects the second pipe to the second plurality of mud circulation system components.

9. The master shaker module of claim 8, wherein the first manifold encourages equal distribution of the fluid to each of the mud circulation system components in the first plurality of mud circulation system components; and wherein the second manifold encourages equal distribution of the fluid to each of the mud circulation system components in the second plurality of mud circulation system components.

10. The master shaker module of claim 1, wherein the second floor is configured to support a mud cleaner; and wherein the first floor includes an opening configured to accommodate a portion of the mud cleaner.

11. The master shaker module of claim 1, wherein at least one mud circulation system component of the first plurality of mud circulation system components is a shale shaker; and wherein at least one mud circulation system component of the second plurality of mud circulation system components is a shale shaker.

12. A method of assembling a master shaker module, the method comprising:

coupling an upper master skid structurally configured to support a first plurality of mud circulation system components over and to a lower master skid structurally configured to support a second plurality of mud circulation system components; wherein the upper master skid comprises a first floor configured to support the first plurality of mud circulation system components;

fluidically connecting a first pipe of the upper master skid to a second pipe of the lower master skid;

fluidically connecting a first storage structure of the upper master skid to a mud cleaner accommodated on the lower master skid, the first storage structure being configured to receive a fluid that exits from the first plurality of mud circulation system components; wherein the first storage structure is in contact with and at least partially disposed below the first floor; and fluidically connecting a first debris moving system of the upper master skid to a chute that vertically extends along the lower master skid, the first debris moving system being structurally configured to move debris that exits from the first plurality of mud circulation system components;

the first pipe is arranged to fluidly communicate with the first plurality of mud circulation system components; and the second pipe is arranged to fluidly communicate with the second plurality of mud circulation system components.

13. The method of claim 12, wherein the upper master skid further comprises:

a first plurality of fasteners carried on the upper master skid; and wherein the lower master skid comprises:

a second floor configured to support the second plurality of mud circulation system components;

a second storage structure at least partially disposed below the second floor and structurally configured to receive the fluid exiting from at least one mud circulation system components from the second plurality of mud circulation system components;

a support structure extending in the vertical direction from the second floor;

a second plurality of fasteners located on the support structure and configured to correspond to the first plurality of fasteners to couple the upper master skid to the lower master skid.

14. The method of claim 13, wherein coupling the upper master skid to the lower master skid comprises:

positioning the upper master skid at a location above the lower master skid;

aligning at least one fastener from the first plurality of fasteners with at least one fastener from the second plurality of fasteners; and coupling at least one fastener from the first plurality of fasteners with at least one fastener from the second plurality of fasteners.

15. The method of claim 12, further comprising aligning the chute of the lower master skid with a second debris moving system that is at least partially located below a support surface upon which the lower master skid rests.

16. The method of claim 12, wherein the first debris moving system comprises:

a trough configured to receive the debris that exits from at least one of the mud circulation system components from the first plurality of mud circulation system components; and a conveyor accommodated within the trough and structurally configured to move the debris that exits from the at least one mud circulation system component from the first plurality of mud circulation system components in a first direction along the trough and to the chute.

17. The method of claim 12, wherein at least one mud circulation system component from the first plurality of mud circulation system components is a shale shaker; and wherein at least one mud circulation system component from the second plurality of mud circulation system components is a shale shaker.

18. The method of claim 12, wherein the upper master skid and the lower master skid are selectively detachable.

19. A method of cleaning mud from a downhole operation, comprising:

flowing a fluid through a first pipe to a first plurality of mud circulation system components accommodated on an upper master skid;

flowing the fluid through a second pipe to a second plurality of mud circulation system components accommodated on a lower master skid that is located below the upper master skid;

accommodating the fluid that exits from at least one of the mud circulation system components of the first plurality of mud circulation system components within a first storage structure that is in contact with and at least partially disposed below a first floor of the upper master skid;

determining whether operation of both the first and second pluralities of mud circulation system components is required to clean the fluid; and closing a valve to prevent the flow of the fluid through one of the first or second pipes after determining that operation of both the first and second pluralities of mud circulation system components is not required.

20. The method of claim 19, wherein at least one mud circulation system component from the first plurality of mud circulation system components comprises a shale shaker; and wherein at least one mud circulation system component from the second plurality of mud circulation system components comprises a shale shaker.

21. The method of claim 19, further comprising:

accommodating the fluid that exits from at least one of the mud circulation system components from the second plurality of mud circulation system components within a second storage structure at least partially disposed below a second floor of the lower master skid.

22. The method of claim 19, further comprising:

receiving debris that exits from at least one of the mud circulation system components from the first plurality of mud circulation system components through a trough formed below the first floor of the upper master skid, the first floor supporting the first plurality of mud circulation system components; and moving the debris using a conveyor that is accommodated within the trough.

23. The method of claim 19, wherein the upper master skid and the lower master skid are selectively detachable.

* * * * *